US010393325B2

(12) United States Patent
Oh

(10) Patent No.: US 10,393,325 B2
(45) Date of Patent: Aug. 27, 2019

(54) MULTIPURPOSE DISASTER SAFETY LANTERN

(71) Applicant: THE GREEN GROWTH CO., LTD., Seongnamsi, Gyeonggi-do (KR)

(72) Inventor: Seung-Chul Oh, Seongnam-si (KR)

(73) Assignee: THE GREEN GROWTH CO., LTD., Seongnam-si (KR)

( * ) Notice: Subject to any disclaimer, the term of this patent is extended or adjusted under 35 U.S.C. 154(b) by 7 days.

(21) Appl. No.: 15/854,275

(22) Filed: Dec. 26, 2017

(65) Prior Publication Data

US 2018/0180227 A1 Jun. 28, 2018

(30) Foreign Application Priority Data

Dec. 28, 2016 (KR) ..... 10-2016-0180868

(51) Int. Cl.

| | |
|---|---|
| ***F21L 4/02*** | (2006.01) |
| ***F21V 23/04*** | (2006.01) |
| ***F21L 19/00*** | (2006.01) |
| ***F21V 33/00*** | (2006.01) |
| ***G08B 17/00*** | (2006.01) |
| ***G08B 5/36*** | (2006.01) |
| ***G08B 5/38*** | (2006.01) |
| *F21W 111/10* | (2006.01) |
| *F21Y 115/10* | (2016.01) |

(52) U.S. Cl.

CPC ..... *F21L 4/027* (2013.01); *F21L 19/00* (2013.01); *F21V 23/0442* (2013.01); *F21V 33/0076* (2013.01); *G08B 5/36* (2013.01); *G08B 5/38* (2013.01); *G08B 17/00* (2013.01); *F21W 2111/10* (2013.01); *F21Y 2115/10* (2016.08)

(58) Field of Classification Search

CPC .. F21L 4/027; F21L 19/00; F21L 4/04; F21W 2111/10; G08B 5/38

See application file for complete search history.

(56) References Cited

U.S. PATENT DOCUMENTS

| | | | | |
|---|---|---|---|---|
| 5,952,916 A * | 9/1999 | Yamabe | B25D 1/00 340/321 |
| 7,670,023 B1 * | 3/2010 | Peterson | F21L 4/027 320/101 |
| 2007/0035944 A1 * | 2/2007 | Dalton | F21L 4/027 362/187 |
| 2017/0130914 A1 * | 5/2017 | Gassauer | F21V 29/89 |

FOREIGN PATENT DOCUMENTS

KR 10-2008-0083247 A 9/2008

* cited by examiner

*Primary Examiner* — Julie A Bannan

(74) *Attorney, Agent, or Firm* — Novick, Kim & Lee, PLLC; Jae Youn Kim

(57) ABSTRACT

There is provided a multipurpose disaster safety lantern including a top body in which a lighting light emitting diode (LED) is accommodated, and which has a reflective guide and a lens configured to direct a light beam radiated from the lighting LED and is formed of rubber having elasticity, an air discharge protrusion which is arranged on aside surface of the top body to communicate with a space between a front surface of the top body and the lens and is formed of rubber having elasticity, and an inside of which is empty, a main body which is coupled to the top body and which forms a body of the lantern, and at least one first LED bar provided on a surface of the main body along a longitudinal direction of the main body.

6 Claims, 7 Drawing Sheets

MULTIPURPOSE DISASTER SAFETY LANTERN

CROSS-REFERENCE TO RELATED APPLICATIONS

This application claims the priority of Korean Patent Application No. 10-2016-0180868 filed on Dec. 28, 2016, in the Korean Intellectual Property Office, the disclosure of which is incorporated herein by reference.

BACKGROUND OF THE INVENTION

Field of the Invention

The present disclosure relates to a multipurpose disaster safety lantern, and more particularly, to a multipurpose disaster safety lantern having various functions, which is suitable for use in accidents or disasters.

Description of the Related Art

A lantern (or a flashlight) is a kind of portable lighting device configured to illuminate a dark place. For example, the lantern is used as a temporary light configured to illuminate a dark warehouse or a corner or used during power failure or a simple light for nighttime outdoor activities.

In recent years, as various accidents or disasters occur frequently, and recognition that a person should protect his/her own safety has been spread, there are more and more people who prepare lanterns as necessary items to be used in an emergency situation.

In order to improve usability of such a disaster safety lantern, a product obtained by adding various functions to a single lantern has been introduced. Until now, a disaster safety lantern having a function suitable for effectively ensuring a safety in a disaster situation and actively requesting a rescue has not been introduced.

RELATED ART DOCUMENT

Patent Document (Patent Document 1) Korean Patent Application Publication No. 10-2008-0083247 (filed on Sep. 17, 2008)

SUMMARY OF THE INVENTION

An aspect of the present disclosure provides a multipurpose disaster safety lantern which may be effectively used in various disaster situations and has a function suitable for actively requesting a rescue.

According to an aspect of the present invention, there is provided a multipurpose disaster safety lantern including a top body in which a lighting light emitting diode (LED) is accommodated, and which has a reflective guide and a lens configured to direct a light beam radiated from the lighting LED, and is formed of rubber having elasticity, an air discharge protrusion which is arranged on a side surface of the top body to communicate with a space between a front surface of the top body and the lens and is formed of rubber having elasticity, and an inside of which is empty, a main body which is coupled to the top body and which forms a body of the lantern, and at least one first LED bar provided on a surface of the main body along a longitudinal direction of the main body.

Here, two air discharge protrusions may be provided to be opposite to each other in a diagonal direction of the top body.

Further, the main body may include a first main body in which the first LED bar is provided and a second main body withdrawably coupled to an inside of the first main body in a sliding manner, and at least one second LED bar may be provided on a surface of the second main body along a longitudinal direction of the second main body.

Further, the lantern may further include a contact switch configured to supply electric power to automatically light on the second LED bar when the second main body is withdrawn from the first main body.

Further, the lantern may further include a motor configured to rotate the main body about the top body.

Further, the lantern may further include a detection sensor configured to detect at least one of heat, gas, and earthquake, and when the detection sensor detects heat, gas, and earthquake corresponding to a predetermined reference value or more, at least one of the lighting LED or the first LED bar is automatically lighted on.

According to one embodiment of the present disclosure, the lighting LED may be a white light LED, and the first LED bar and the second LED bar may be red light LEDs.

Further, the lantern may further include an elastic hook having a ring coupling part elastically coupled to a rear portion of the main body and a plurality of hooks extending along an outer circumference of the ring coupling part.

Accordingly, the multipurpose disaster safety lantern according to the present disclosure may further include a fire extinguisher having a cap elastically coupled to the elastic hook, in which the multipurpose disaster safety lantern and the fire extinguisher constitute a set.

Meanwhile, in the multipurpose disaster safety lantern according to the present disclosure, in a state in which the air discharge protrusion is pressed, the front surface of the top body comes into close contact with a smooth surface, and in s state in which the close contact is maintained, the air discharge protrusion elastically returns to form a negative pressure in a space between the front surface of the top body and the lens, so that the multipurpose disaster safety lantern is attached to the smooth surface, and the first LED bar or the first LED bar and the second LED bar are lighted on and are used as a warning light.

At this time, the multipurpose disaster safety lantern according to the present disclosure may further include a motor configured to rotate the main body about the top body, in which when the multipurpose disaster safety lantern is used as a warning light, the motor may be operated.

In addition, the multipurpose disaster safety lantern according to the present disclosure may further include a speaker or a low frequency generator configured to generate a warning sound.

In the above-described multipurpose disaster safety lantern according to the present disclosure, because the lantern is attached and fixed by using the atmospheric pressure without a separate additional means, and is then used as a warning light, the lantern may indicate a warning thereabout or may effectively notify of a location thereof.

Further, because a long warning light may be made and used by pulling out the second main body from the first main body, a visible distance of the warning light may be increased even in a place having poor visibility.

In addition, the multipurpose disaster safety lantern is rotated by using a motor, so that a function as the warning light may be further enhanced.

Further, the detection sensor is provided to receive a warning about dangerous factors such as earthquake, fire, and gas leakage in a disaster situation. Furthermore, when a dangerous situation such as earthquake, fire, and gas leakage occurs in a state in which the location of the lantern cannot be identified due to power failure or the like caused by the disaster, the lighting LED or the first LED bar is automatically lighted on to notify of the location of the lantern, so that the user may be induced to quickly evacuate from danger.

Further, because a set is constituted by connecting the multipurpose disaster safety lantern according to the present disclosure and the first extinguisher, it is easy to find the lantern as the multipurpose disaster safety lantern is attached to the fire extinguisher placed in a visible location. Further, in case of emergency, the multipurpose disaster safety lantern and the fire extinguisher may be acquired once, so that the user may further effectively cope with a disaster situation.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
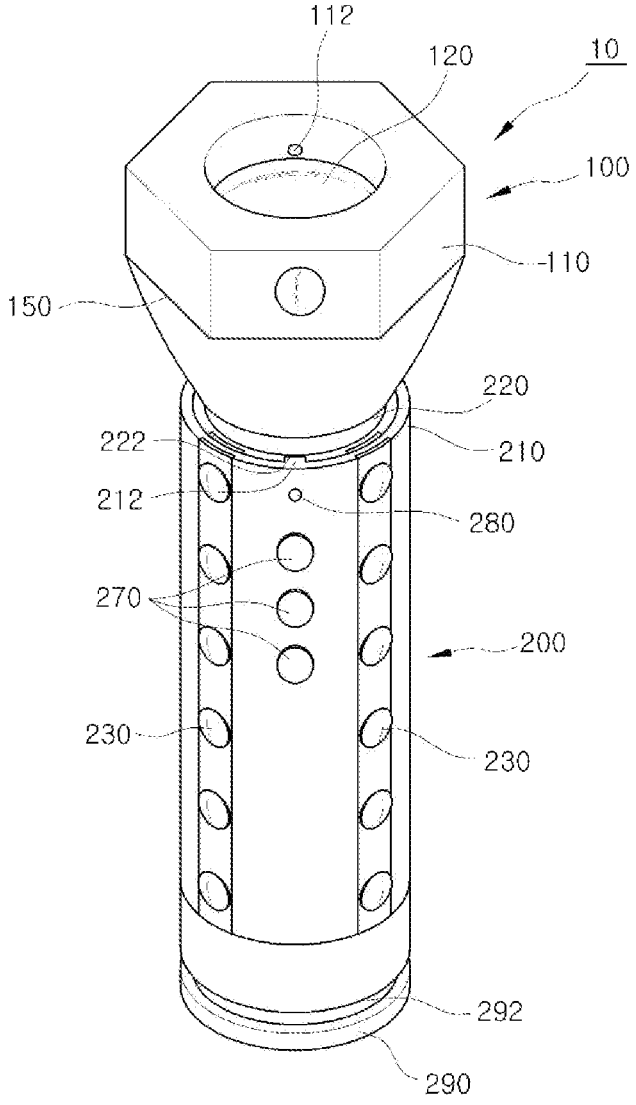
FIG. 1 is a perspective view illustrating a multipurpose disaster safety lantern according to the present disclosure.

Hereinafter, exemplary embodiments of the present disclosure will be described in detail with reference to the accompanying drawings.

When the exemplary embodiments of the present disclosure are described, description of widely-known configurations that may be obviously understood by those skilled in the art will be omitted so as not to make the subject matter of the present disclosure unclear. Further, when components in the accompanying drawings are designated by reference numerals, the same components are designated by the same reference numerals as much as possible even though the components are illustrated in different drawings. Further, it should be considered that when the drawings are referenced, the thicknesses of lines and the sizes of components illustrated in the drawings may be exaggeratedly illustrated for clarity and convenience of description.

Further, terms such as first, second, A, B, (a), (b) or the like may be used herein when components of embodiments of the present disclosure are described. Each of these terms is not used to delimit an essence, an order or a sequence of a corresponding component but used merely to distinguish the corresponding component from other component(s). It should be understood that when one component is "connected", "coupled" or "joined" to another component, the former may be directly connected or jointed to the latter or may be indirectly "connected", "coupled" or "joined" to the latter with a third component interposed therebetween.

Figure 2:
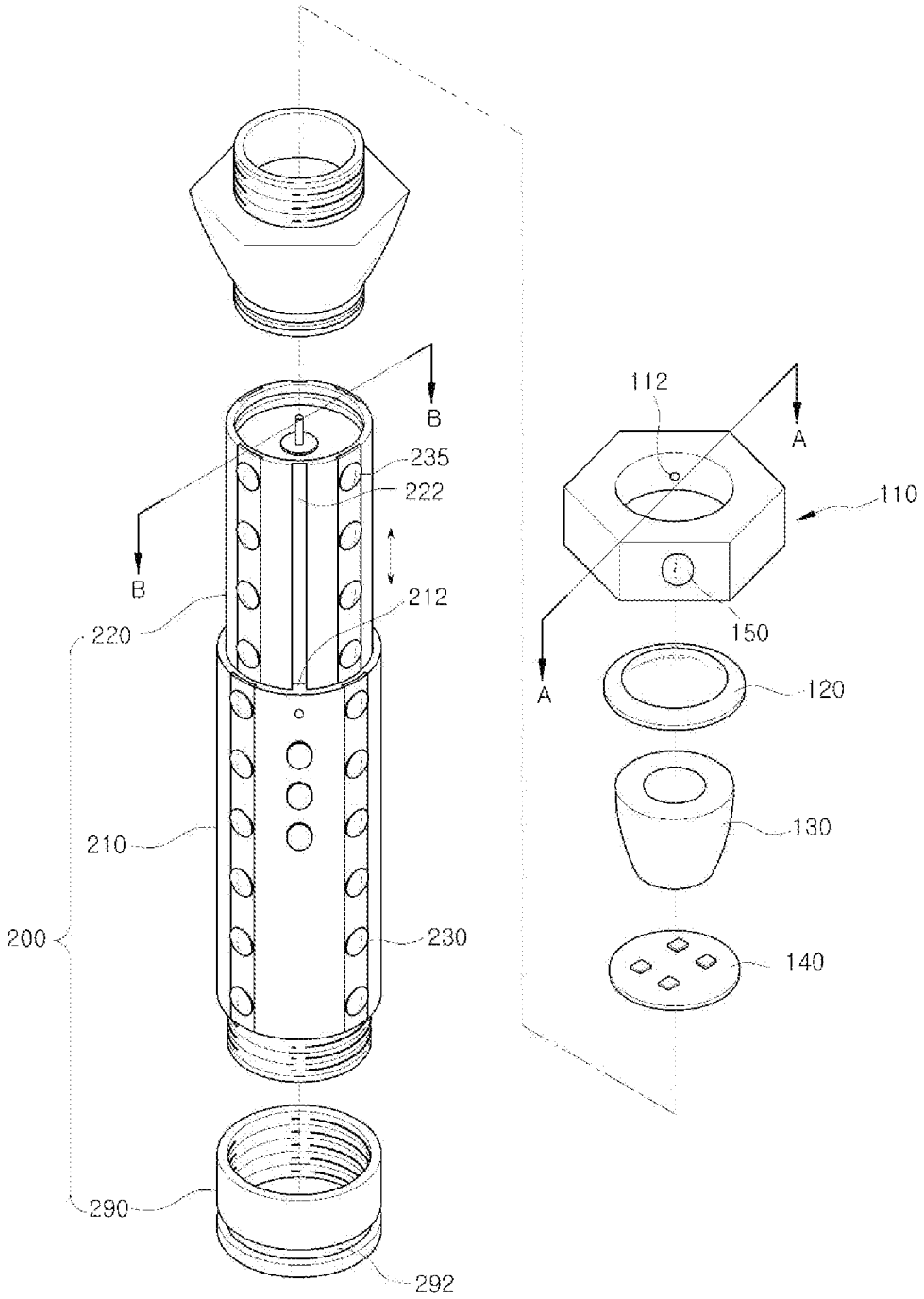
FIG. 2 is an exploded perspective view illustrating the multipurpose disaster safety lantern according to the present disclosure.

FIG. 1 is a perspective view illustrating a multipurpose disaster safety lantern 10 according to the present disclosure, and FIG. 2 is an exploded perspective view illustrating the multipurpose disaster safety lantern 10 according to the present disclosure. The present disclosure will be described in detail with reference to the drawings. Further, in description of the present disclosure, in consideration of a state in which the lantern 10 is used while being gripped by a hand, a side of a top body 100 from which an illumination light of the lantern 10 is radiated is referred to as a front side (a front surface), and a side that is opposite thereto is referred to as a rear side (a rear surface).

As illustrated in FIGS. 1 and 2, the multipurpose disaster safety lantern 10 according to the present disclosure includes the top body 100 as a head portion and a main body 200 forming a body gripped by a hand, in which an air discharge protrusion 150 is formed on a side surface of the top body 100, and at least one first light emitting diode (LED) bar 230 is arranged along a longitudinal direction of the main body 200.

The top body 100 accommodates a lighting LED 140, and additionally includes a mirror-finished reflective guide 130 and a lens 120 configured to direct a light beam radiated from the lighting LED 140. In particular, the top body 100 is formed of rubber having elasticity. Here, the entire top body 100 may be formed of rubber having elasticity or only a top cover 110 (a part defining a front surface of the top body 100) in which the air discharge protrusion 150 is formed may be formed of rubber having elasticity.

Figure 3:
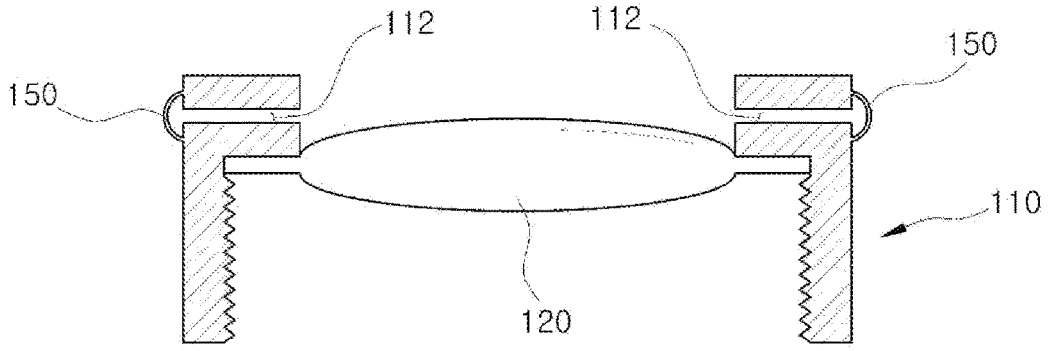
FIG. 3 is a sectional view taken along line A-A of FIG. 2.

Further, the air discharge protrusion 150 is a convex protrusion arranged on a side surface of the top body 100 to communicate with a space formed between the front surface of the top body 100 and the lens 120 through an air passage 112 and also formed of rubber having elasticity, and an interior of the air discharge protrusion 150 is empty. That is, an inner space of the air discharge protrusion 150 and the space formed between the front surface of the top body 100 and the lens 120 define one connected space, and the air discharge protrusion is pressed to make it flat, so that the volume of a space in which air is accommodated may be changed. A communicating structure of such an air discharge protrusion 150 is illustrated in the sectional view of FIG. 3 well.

The air discharge protrusion 150 may be formed integrally with the top body 100 or may be separately formed and be attached to the top body 100. Thus, although both the air discharge protrusion 150 and the top body 100, particularly, the top cover 110, are formed of rubber having elasticity, the rubber may not be same. A role of such an air discharge protrusion 150 will be described below in detail with reference to FIGS. 5 and 6.

Further, at least one first LED bar 230 is provided on a surface of the main body 200 along a longitudinal direction of the main body 200. The first LED bar 230 is a band-shaped LED lighting means in which a plurality of LED units is arranged in rows. As compared with the lighting LED 140 provided in the top body 100 to perform a lighting function of illuminating the front side, the first LED bar 230 irradiates a light beam to the lateral side to serve as a warning light configured to indicate warnings therearound or notify of a location thereof.

Figure 4:
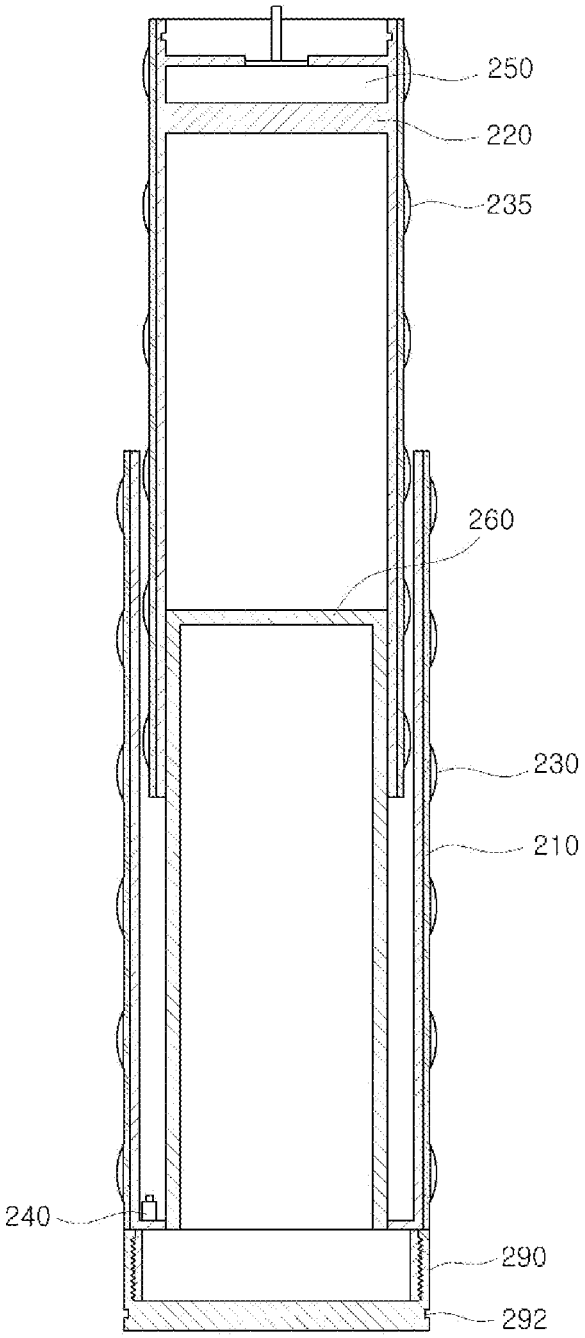
FIG. 4 is a sectional view taken along line B-B of FIG. 2.

Further, as in modes of the present disclosure illustrated in FIGS. 2 and 4, the main body 200 may be formed in a dual structure including a first main body 210 in which the first LED bar 230 is provided and a second main body 220 withdrawably coupled to an inside of the first main body 210 in a sliding manner. Further, at least one second LED bar 235 is provided on a surface of the second main body 220 along a longitudinal direction of the second main body 220.

A straight protrusion 212 is formed along a longitudinal direction of an inner peripheral surface of the first main body 210, and a straight groove 222 corresponding to the straight protrusion 212 is formed along a longitudinal direction of an outer peripheral surface of the second main body 220. Thus, the second main body 220 may be withdrawn from or inserted into the first main body 210 in a sliding manner by coupling between the straight protrusion 212 and the straight groove 222. As a result, the entire length or the entire height of the lantern 10 may be adjusted through the withdrawal and the insertion of the second main body 220.

The second LED bar 235 provided on the surface of the second main body 220 is also a lighting means functioning as a warning light, which is like the first LED bar 230. That is, a long warning light may be formed by pulling out the second main body 220 from the first main body 210, and through this, a user may increase a visible distance of the warning light in a place with poor visibility.

Here, it is preferable that the lighting LED 140 is a white light LED because the lighting LED 140 is important for a lighting function for illuminating a dark place. Further, it is effective that the first LED bar 230 and the second LED bar 235 are red light LED bars in consideration of a function as the warning light.

For reference, the sectional view of FIG. 4 mainly illustrates a sliding structure of the first main body 210 and the second main body 220, and configurations of a control board, an electrical connection line and the like are omitted. Because electrical configurations of the lantern 10 correspond to a general technology, it is not difficult to understand the present disclosure even when the electrical configurations are omitted. Preferably, illustrating the electrical configurations makes the configurations of the present disclosure unnecessarily complex, thereby hindering the understanding of the present disclosure. Further, not-described reference numeral "260" indicates a battery holder into which a battery is inserted.

Further, the second LED bar 235 needs not to be operated when the second main body 220 is inserted into the first main body 210, and the operation of the second LED bar 235 is firstly effective only when the second main body 220 is withdrawn from the first main body 210. Thus, it is convenient to automatically operate the second LED bar 235 with no need to provide a separate power switch 270 configured to operate the second LED bar 235, when the second main body 220 is withdrawn from the first main body 210.

To this end, the present disclosure further includes a contact switch 240 configured to supply an electric power to automatically light on the second LED bar 235 when the second main body 220 is withdrawn from the first main body 210. FIG. 4 illustrates a state in which the mechanical contact switch 240 is provided on an inner side of a bottom of the first main body 210, and when the second main body 220 is separated from the mechanical contact switch 240, a contact point is operated. However, this is merely one mode, and the position of the contact switch 240 may be appropriately selected other than the illustrated position. Further, a magnetic switch using a magnet may be applied other than the mechanical contact switch 240. In this way, types of switches are not limited.

Figure 5:
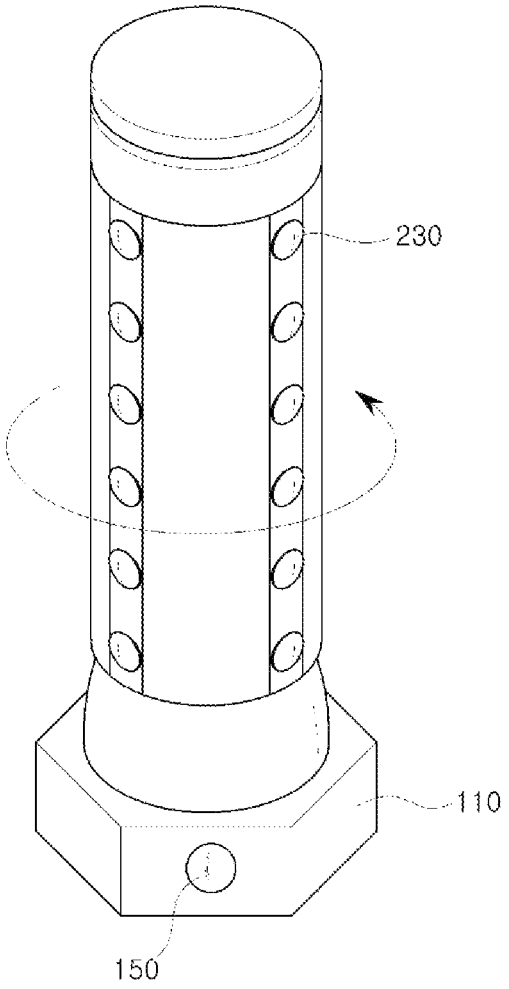
FIG. 5 is a view illustrating an example where the multipurpose disaster safety lantern according to the present disclosure is used as a warning light.
Figure 6:
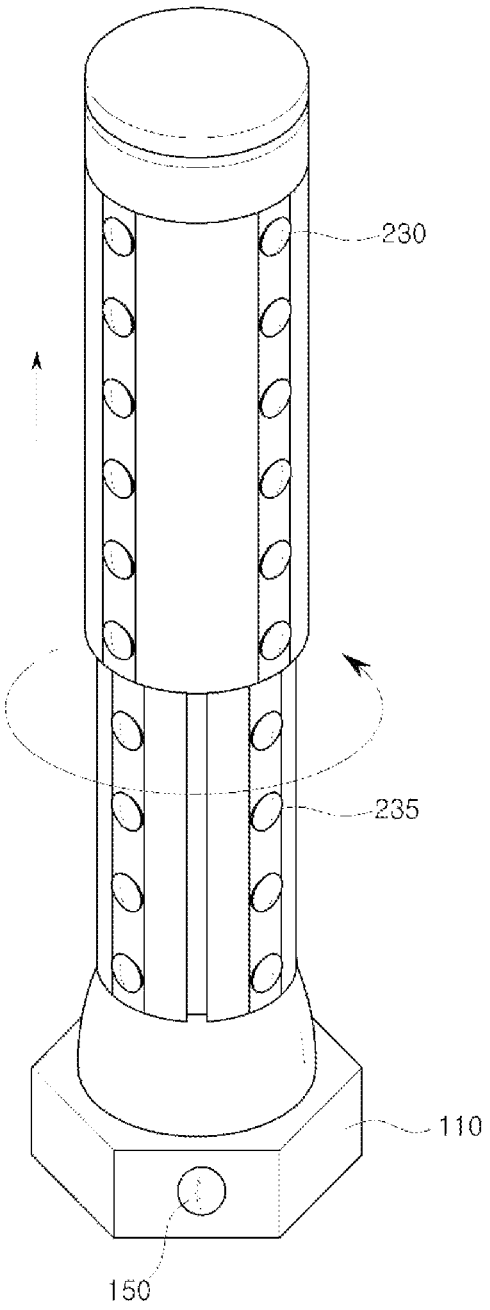
FIG. 6 is a view illustrating an example where the multipurpose disaster safety lantern of FIG. 5 is pulled out and is used as a warning light.

FIGS. 5 and 6 illustrate two modes in which the multipurpose disaster safety lantern 10 according to the present disclosure is used as a warning light. FIG. 5 illustrates a case where only the first LED bar 230 is used as a warning light, and FIG. 6 illustrates a case where both the first LED bar 230 and the second LED bar 235 are used as a warning light by pulling out the second main body 220. The two drawings are the same in a basic form in which the multipurpose disaster safety lantern 10 according to the present disclosure is used as a warning light.

A method of using the multipurpose disaster safety lantern 10 according to the present disclosure as a warning light will be described below.

First, in a state in which the air discharge protrusion 150 provided on the side surface of the top body 100 is pressed by a finger, the front surface of the top body 100 comes into close contact with a smooth surface, for example, a roof of a vehicle, a trunk lid surface, or a glass surface. As described above, because the entire top body 100 or at least the top cover 110 is formed of rubber having elasticity, when the front surface of the top body 100 is pressed against the smooth surface, the front surface of the top body and the smooth surface tightly come into close contact with each other without a gap through which air is leaked.

In this way, when the pressing finger is separated to elastically return the air discharge protrusion 150 in a state in which the close contact is maintained, a part of air existing in the space between the front surface of the top body 100 and the lens 120 moves to the air discharge protrusion 150, which becomes convex again, through the air passage 112. A negative pressure, which is not more than the atmospheric pressure, is formed in an inner space of the top body 100 by such movement of the air, and accordingly the multipurpose disaster safety lantern 10 according to the present disclosure, which is in close contact with the smooth surface, is stably fixed to the smooth surface by a force of the atmospheric pressure.

Further, two air discharge protrusions 150 may be arranged to be opposite to each other in a diagonal direction of the top body 100. This is because the strength of the negative pressure formed in the inner space of the top body 100 may increase as the number of the air discharge protrusions 150 is increased to two, and it is convenient to press the air discharge protrusions 150 with a big finger and an index finger when the air discharge protrusions 150 are arranged to be opposite to each other in a diagonal direction.

In this way, when the multipurpose disaster safety lantern 10 is fixed to any surface, the first LED bar 230 or the first LED bar 230 and the second LED bar 235 are lighted on and are thus effectively used as a warning light.

Here, it is effective that the first LED bar 230 and the second LED bar 235 are rotated to increase the function as a warning light.

Here, a method of rotating the first LED bar 230 and the second LED bar 235 includes a method in which individual LEDs are electrically lighted on/off using a control board so that the first LED bar 230 and the second LED bar 235 visually seem to rotate, and a method in which the first LED bar 230 and the second LED bar 235 are physically rotated by using a motor.

Because the method using electrical lighting on/off is a general method, the detailed description thereof will be omitted herein, and only the method using the motor will be described below.

To this end, a motor 250 configured to rotate the main body 200 about the top body 100 may be provided, and this is illustrated in FIGS. 2 and 4 well.

In the illustrated mode, a rotary shaft of the motor 250 protrudes outward from the front surface of the main body 200. The main body 200 and the top body 100 are fitted in and coupled to each other through an annular groove and protrusion structure to enable mutual rotation, and the protruding rotary shaft of the motor 250 is inserted into a hole formed on a bottom surface of the top body 100 and is firmly fixed to the top body 100. Thus, as illustrated in FIGS. 5 and 6, when the motor 250 is driven in a state in which the front surface of the top body 100 is attached and fixed to any smooth surface, the main body 200 is rotated, and accordingly the first LED bar 230 or the first LED bar 230 and the second LED bar 235, which are lighted on, radiate a red light beam in all directions while being continuously rotated, which is like a warning light of an ambulance or a police car.

Because the multipurpose disaster safety lantern 10 according to the present disclosure has various above-described functions, three power switches 270 for lighting on the lighting LED 140, the first LED bar 230, and the motor 250 are required. Here, as described above, because the second LED bar 235 may be automatically lighted on by using the contact switch 240, the switch for lighting on the second LED bar 235 is not necessarily required. Of course, because functions may be operated in a cyclic manner according to the number of times of pressing even when one power switch is provided, a configuration of the power switch 270 illustrated in the drawing should be understood as one example.

Additionally, the multipurpose disaster safety lantern 10 according to the present disclosure may further include a detection sensor 280 configured to detect at least one of heat, gas, and earthquake, and may automatically light on at least one of the light LED 140 and the first LED bar 230 when the detection sensor 280 detects heat, gas, and earthquake corresponding to a predetermined reference value or more. Here, various sensors may be used as a sensor configured to detect earthquake, and an example of the sensor is a pressure sensor.

When such a detection sensor 280 is provided, in the event of a disaster, the user will be warned about the risk of earthquake, a fire, or gas leakage. Furthermore, when a dangerous situation such as earthquake, a fire, and gas leakage occurs in a state in which the location of the lantern 10 cannot be identified due to power failure or the like caused by the disaster, the light LED 140 or the first LED bar 230 is automatically lighted on to notify the user of the location of the lantern 10, so that the lantern 10 is useful in that the lantern 10 allows the user to quickly evacuate from danger.

Further, a speaker that may generate a warning sound may be additionally provided in addition to the lighting on of the light. In an emergency time, the speaker additionally generates a warning sound to allow the user to more quickly evacuate from danger. Further, a low frequency generator may be provided for facilitating location tracking by using a low frequency generated thereby when the user is isolated due to a natural disaster such as earthquake, a fire, and gas leakage.

Figure 7:
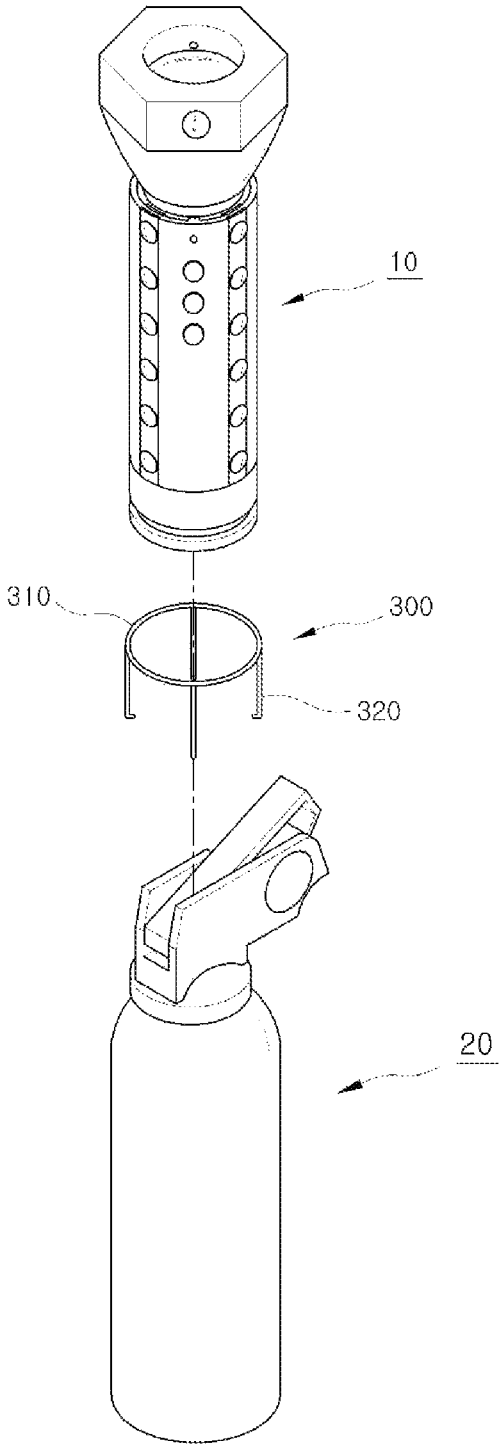
FIG. 7 is a view illustrating a configuration in which the multipurpose disaster safety lantern according to the present disclosure and a fire extinguisher constitute a set.

Further, as illustrated in FIG. 7, the multipurpose disaster safety lantern 10 according to the present disclosure and a fire extinguisher 20 constitute a set, so that the lantern 10 may be more useful for disaster situations.

On a rear side of the main body 200, in the illustrated mode, an annular groove 292 is formed along an outer circumferential surface of a lower cap 290 configured to open or close the battery holder 260, and an elastic hook 300 having a ring coupling part 310 elastically coupled to the annular groove 292 and a plurality of hooks 320 extending along an outer circumference of the ring coupling part 310 is provided.

Further, the multipurpose disaster safety lantern 10 and the fire extinguisher 20 are elastically coupled to each other by catching hooks at distal ends of the hooks 320 extending downward of the elastic hook 300 by a lower end step of an upper end cap of the fire extinguisher 20, and when a fire is suppressed, the fire extinguisher 20 may be slantingly bent with respect to the elastic hook 300, and may be quickly separated and used.

When a set is constituted by connecting the multipurpose disaster safety lantern 10 and the fire extinguisher 20 to each other, because the multipurpose disaster safety lantern 10 is attached to the fire extinguisher 20 located in a visible location, it is easy to find the lantern 10, and the multipurpose disaster safety lantern 10 and the fire extinguisher 20 may be acquired once in case of emergency, so that the user may more effectively cope with a disaster situation.

Although exemplary embodiments and modes of the present disclosure have been illustrated and described above, it can be identified that the present embodiment may be modified by those skilled in the art to which the present disclosure pertains without departing from the principle and the spirit of the present disclosure. Thus, the scope of the right of the present disclosure is defined by the appended claims and equivalents thereto.

What is claimed is:

1. A multipurpose disaster safety lantern comprising:

a top body in which a lighting light emitting diode (LED) is accommodated, and which has a reflective guide and a lens configured to direct a light beam radiated from the lighting LED, and is formed of rubber having elasticity;

an air discharge protrusion which is arranged on a side surface of the top body to communicate with a space between a front surface of the top body and the lens and is formed of rubber having elasticity, and an inside of which is empty;

a main body which is coupled to the top body and which forms a body of the lantern; and at least one first LED bar provided on a surface of the main body along a longitudinal direction of the main body.

2. The multipurpose disaster safety lantern of claim 1, wherein the main body includes a first main body in which the at least one first LED bar is provided and a second main body withdrawably coupled to an inside of the first main body in a sliding manner, and wherein at least one second LED bar is provided on a surface of the second main body along a longitudinal direction of the second main body.

3. The multipurpose disaster safety lantern of claim 2, further comprising:

a contact switch configured to supply electric power to automatically light on the at least one second LED bar when the second main body is withdrawn from the first main body.

4. The multipurpose disaster safety lantern of claim 1, wherein the lantern further includes a detection sensor configured to detect at least one of heat, gas, and an earthquake, and wherein when the detection sensor detects the at least one of the heat, the gas, and the earthquake corresponding to a predetermined reference value or more, at least one of the lighting LED and the first LED bar is automatically lighted on.

5. The multipurpose disaster safety lantern of claim 1, further comprising:

an elastic hook having a ring coupling part elastically coupled to a rear portion of the main body and a plurality of hooks extending along an outer circumference of the ring coupling part; and a fire extinguisher having a cap elastically coupled to the elastic hook.

6. The multipurpose disaster safety lantern of claim 1, further comprising:

a speaker or a low frequency generator configured to generate a warning sound.

* * * * *